US006812683B1

(12) United States Patent
Lorenz

(10) Patent No.: US 6,812,683 B1
(45) Date of Patent: Nov. 2, 2004

(54) REGULATION OF THE DRAIN-SOURCE VOLTAGE OF THE CURRENT-SOURCE IN A THERMAL VOLTAGE (VPTAT) GENERATOR

(75) Inventor: Perry Scott Lorenz, Fort Collins, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/422,868

(22) Filed: Apr. 23, 2003

(51) Int. Cl.[7] ..... G05F 3/16
(52) U.S. Cl. ..... 323/312; 323/907
(58) Field of Search ..... 323/312, 314, 323/316, 907

(56) References Cited

U.S. PATENT DOCUMENTS 3,617,859 A * 11/1971 Dobkin et al. ..... 323/313
4,587,478 A * 5/1986 Kasperkovitz et al. ..... 323/316
4,665,356 A * 5/1987 Pease ..... 323/314
4,879,505 A * 11/1989 Barrow et al. ..... 323/312
5,920,184 A * 7/1999 Kadanka ..... 323/314

* cited by examiner

*Primary Examiner*—Jeffrey Sterrett
(74) *Attorney, Agent, or Firm*—Mark R. Hennings; Merchant & Gould

(57) ABSTRACT

A drain-source voltage regulator in a VPTAT generator operates with a lower minimum Vdd and provides a regulated current-mirror voltage. The minimum Vdd can be expressed as Vdd_min=Vdsat_cs+Vdsat_amp+VGS_pmir. Regulation of the current-mirror voltage is achieved by using a common-gate configuration to generate a low-voltage reference. The low-voltage reference is generated inside a regulated feedback loop that includes the VPTAT generator. The current-mirror voltage, which is outside the loop, is indirectly regulated. The current-mirror voltage can be regulated within a voltage range that spans from tens of millivolts to hundreds of millivolts.

20 Claims, 3 Drawing Sheets

REGULATION OF THE DRAIN-SOURCE VOLTAGE OF THE CURRENT-SOURCE IN A THERMAL VOLTAGE (VPTAT) GENERATOR

FIELD OF THE INVENTION

The present invention relates generally to thermal voltage generators, VBE references ("bandgaps"), and more particularly to bias current regulation within thermal voltage generators.

BACKGROUND OF THE INVENTION

Thermal voltage (VPTAT) generators are used to develop bias currents and are commonly used within bandgap voltage references. VPTAT generators operate by developing a delta_VBE and applying the developed delta_VBE across a resistor. A junction area ratio of 1-to-8 is typically used to develop the delta_VBE. An amplifier is typically used to maintain equal voltages and to establish the delta_VBE across the resistor. When VPTAT generators are implemented using CMOS processes, the junctions are typically formed as vertical substrate PNP junctions and the amplifier is typically implemented using a pair of NMOS devices. The NMOS amplifier input pair uses a current source, which is typically provided by an NMOS current-mirror.

FIG. 1 is a conventional VPTAT generator that is implemented using a CMOS process. The VPTAT generator comprises transistors Q7–Q8, Ma1–Ma4, M3–M6, Mk3–Mk6, M11, Mk11, Mm21–Mm22, M78, and resistive device Rtv1.

In a VPTAT generator (such as shown in FIG. 1), the base-emitter voltage (VBE) of the vertical PNP transistors roughly cancels the gate-source voltage (VGS) of the NMOS amplifier. However, the voltage that is used to bias the vertical PNP transistors is raised to a level that is sufficient to accommodate the NMOS current source for the NMOS amplifier. Raising the bias voltage by the full of amount necessary to reach the VGS threshold also raises the minimum voltage (Vdd_min) at which the thermal voltage generator will work. Accordingly, Vdd_min of conventional methods can be expressed as:

$$Vdd_\mathrm{min}=VGS_m78+VBE_q7-VGS_amp+Vdsat_amp+VGS_pmir$$

where VGS_amp is the VGS of the amplier input pair. (The body-effect will increase the voltage threshold.) Vdsat_amp is the Vdsat of the NMOS amplifier input pair, and VGS_pmir is the VGS of the PMOS mirrors.

An appreciation of the present invention and its improvements can be obtained by reference to the accompanying drawings, which are briefly summarized below, to the following detailed description of illustrated embodiments of the invention, and to the appended claims.

DETAILED DESCRIPTION OF THE PREFERRED EMBODIMENT

Figure 1:
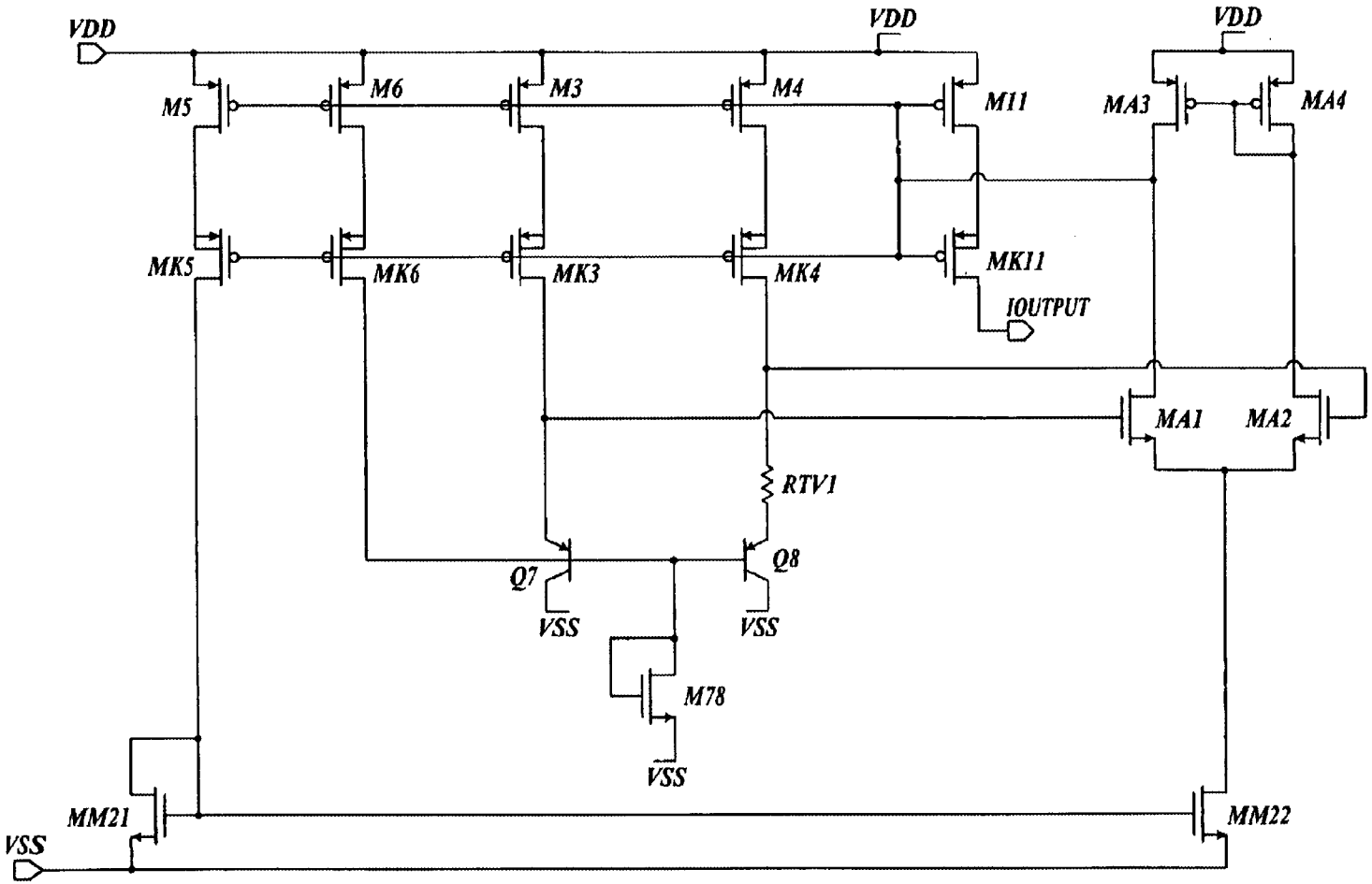
FIG.1 (PRIOR ART)
FIG. 1 is a schematic diagram of a conventional VPTAT generator.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

The present invention is directed towards a drain-source voltage regulator in a VPTAT generator that is capable of operating at a low Vdd current-mirror voltage. The minimum Vdd used to supply the drain-source voltage regulator can be expressed as:

$$Vdd_\mathrm{min}=Vdsat_cs+Vdsat_amp+VGS_pmir$$

where Vdsat_cs is the Vdsat of a current source, where Vdsat_amp is the Vdsat of an amplifier, and where VGS_pmir is the VGS of a current-mirror. Regulation of the current-mirror voltage is achieved by using an emitter voltage of a VPTAT generator transistor pair in a negative feedback loop to drive the common bases of the VPTAT generator transistor pair. The current-mirror voltage can be regulated within a voltage range that spans from tens of millivolts to hundreds of millivolts.

Figure 2:
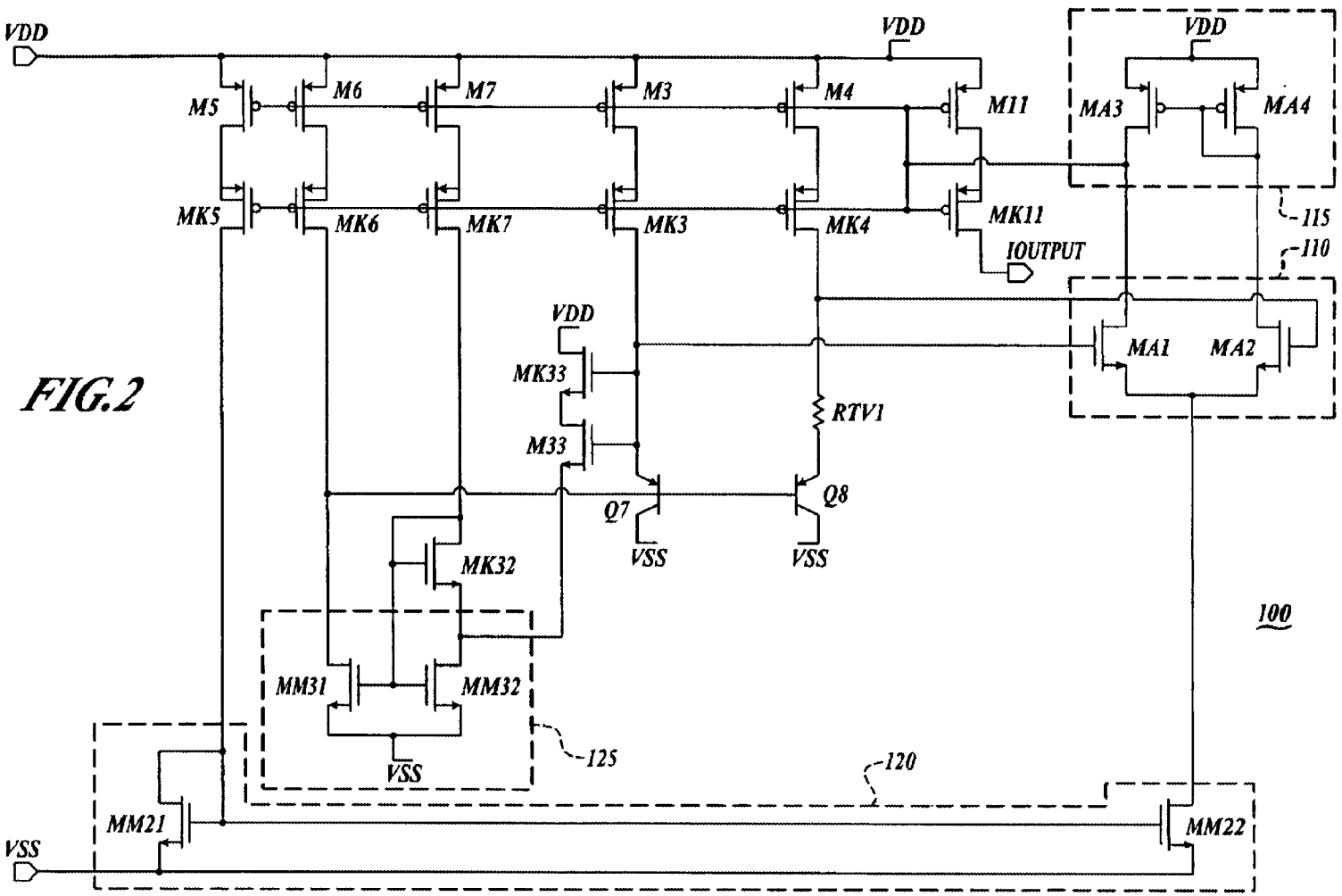
FIG. 2 is a schematic diagram of a drain-source voltage regulator in a VPTAT generator in accordance with the present invention.

FIG. 2 is a schematic diagram of an example drain-source voltage regulator in a VPTAT generator in accordance with the present invention. As shown in the figure, VPTAT generator 100 comprises transistors Q7–Q8, Ma1–Ma4, M3–M7, Mk3–Mk7, M11, Mk11, Mm21–Mm22, Mm31–Mm32, Mk32, M33, Mk33, and resistive device Rtv1.

According to one embodiment, transistors Q7 and Q8 are vertical PNP transistors that form a VPTAT generator transistor pair. Resistive device Rtv1 has a first terminal that is coupled to the emitter of transistor Q8 and a second terminal that is coupled to node INP. Transistors Ma1 and Ma2 form amplifier 110 that is configured to drive node INP and the emitter of Q7 (node INN) such that node INP and node INN are equal. Transistors Ma3 and Ma4 form current-mirror 115 that is driven by amplifier 110. Transistors Mm21 and Mm22 form current-mirror 120. Transistor Mm22 of current-mirror 120 is configured to drive amplifier 110.

Transistors M3–M4 and Mk3–Mk4 are arranged as a current source in a common-gate cascode configuration that is further arranged to be driven by amplifier 110 to equalize nodes INN and INP. The common-gate cascode configurations are space efficient in part because additional bias circuitry is not required. The common-gate cascode is also directed towards achieving large Early voltages, achieving high output impedances, equalizing VDSs, and improving power supply rejection capabilities.

Transistor pairs M5 and Mk5, M6 and Mk6, and M7 and Mk7 are arranged as current sources in a common-gate cascode configuration that tracks current sources M3 and M4. Transistors M11 and Mk11 are arranged as a current source in a common-gate cascode configuration that is coupled to node Ioutput.

Transistors Mm31, Mm32, Mk32 are arranged as current-mirror 225 with a common-gate cascode. The drain of transistor Mk32 and the gates of transistors Mm31, Mm32, and Mk32 are coupled to the current source formed by transistors Mk7 and M7. The drain of transistor Mm31 is coupled to the current source formed by transistors Mk6 and M6. The drain of transistor Mk32 is coupled to the source of transistor Mm32 at node REF.

Transistor M33 is arranged as a source-follower that has an output that is coupled to node Ref. Transistor Mk33 is a common-gate cascode. The gates of transistors Mk33 and M33 are coupled to node INN.

In operation, a reference voltage is established at node Ref. The reference voltage is determined by the VGS of transistor Mm32 minus the VGS of transistor Mk32. Transistor Mm32 is a "long" device and transistor Mk32 is a "short" device, which raises the source voltage of Mk32 significantly above ground. The reference voltage is summed with an input signal (provided by the source of transistor M33) at node Ref. The output current at the drain of transistor Mm31 varies in response to the input signal moving up or down.

Node Ref drives the common bases of transistors Q7 and Q8 at node base 78. The voltage of the emitter of transistor Q7 follows the voltage present at the base of transistor Q7 such that the emitter voltage is a junction voltage higher than the base voltage.

The emitter voltage of transistor Q7 drives the gate of transistor M33. The voltage of the source of transistor follows the voltage present at the gate of transistor M33 such that the source voltage is a VOS (of transistor M33) lower than the gate voltage. Accordingly, a feedback loop is established (which includes transistors Q7, M33, Mm31–Mm32, and Mk32) thereby regulating the voltage at node Ref.

The emitter voltage of transistor Q7 is also used to drive the gate of transistor Ma1 of amplifier 110 such that the source voltage of transistor Ma1 is a VGS (of transistor Ma1) lower than the gate voltage. The drain-source voltage of transistor Mm22 of current source 120 is indirectly regulated because the source of transistor Ma1 establishes the VDS of transistor Mm22.

To illustrate the feedback loop, a rise (for example) in the voltage at node base 78 results in a rise in the voltage at the emitter of Q7. The source voltage of transistor M33 rises in response to the rise of the emitter voltage of Q7. The source of transistor Mk32 rises in response to the increase of the transistor M33 source voltage. The current that would otherwise flow through transistor Mk32 is directed towards the gates of transistors Mm31, Mm32, and Mk32, which causes the voltage present at the gates to increase. More current flows through transistor Mm31 in response to the increased gate voltage. When more current flows through transistor M31, the voltage at node base 78 decreases.

In accordance with the general description above, the minimum supply voltage (Vdd_min) at which VPTAT generator 100 is operable can be expressed as:

$$Vdd_min = Vdsat_cs + Vdsat_amp + VGS_pmir$$

where Vdsat_cs is the Vdsat of current source 120, where Vdsat_amp is the Vdsat of amplifier 110, and where VGS_pmir is the VGS of current-mirror 115. Both Vdsat_cs and Vdsat_amp can be as low as 100 mV or even less. Because Vdd_min is independent of the VBE of transistors Q7 and Q8 (i.e., the vertical PNPs), Vdd_min is largely (but not completely) independent of temperature.

Figure 3:
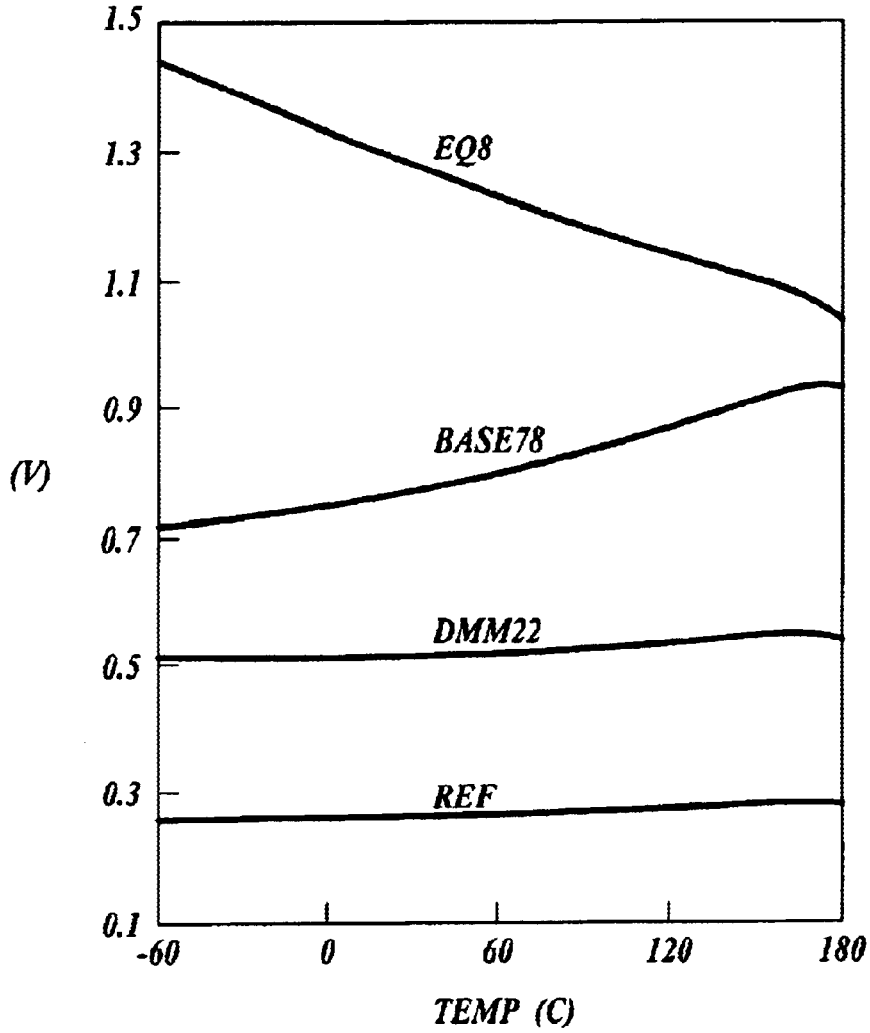
FIG. 3 is a graph generally illustrating the signals at certain nodes illustrated in FIG. 2 as a function of temperature in accordance with the present invention.

FIG. 3 is a graph generally illustrating the signals at certain nodes illustrated in FIG. 2 as a function of temperature in accordance with the present invention. FIG. 3 more specifically graphs the voltages at node eQ8, node base 78, node dMm22, and node Ref over a temperature range. As shown in the figure, signal eQ8 (which is the voltage present at the emitter of transistor Q8) falls in response to rising temperature. Signal base 78 (which is the base voltage of transistors Q7 and Q8) rises in response rising temperature. The drain of transistor Mm22 (signal dMm22) is maintained at a voltage close to 500 mV. (Signal dMm22 is illustrated with a nominal voltage of 500 mV, which allows, for example, higher operating voltages for any particular purpose.) Signal ref gradually rises from 250 mV to 300 mV over temperature. The slopes of signal ref and signal dMm22 can be changed by adjusting parameters associated with transistors Mm31, Mm32, and Mk32, and M33. The parameters can be adjusted such that the slope of signal ref can be flattened over temperature, so that the circuit could be used as if it were a bandgap generator.

Various embodiments of the invention are possible without departing from the spirit and scope of the invention. For example, the circuit can be used to provide a minimum Vdd as described above. Alternatively, a slightly higher Vdd of around 500 mV can be achieved. Moreover, the circuit can be optimized for greatest stability over temperature, which permits the circuit to be used as a stable voltage reference (such as a bandgap generator).

Other embodiments of the invention are possible. For example, transistors shown as being implemented using MOS technology could be implemented using bipolar technology. Additionally, a start up circuit can be used to ensure that the VPTAT generator is initialized properly upon application of power.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A circuit for providing a regulated signal over a temperature range, comprising:

an amplifier, a first transistor that has an emitter that is coupled to a first control terminal of the amplifier;

a resistive element that has a first terminal that is coupled to a second control terminal of the amplifier;

a second transistor that has an emitter that is coupled to a second terminal of the resistive device;

a follower that has a control terminal that is coupled to the first control terminal of the amplifier;

a third transistor that has a first non-control terminal that is coupled to an output of the follower; and a fourth transistor that has a first non-control terminal that is coupled to the first non-control terminal of the third transistor, and a control terminal that is coupled to a control terminal of the third transistor.

2. The circuit of claim 1, further comprising a fifth transistor that has a control terminal that is coupled to the control terminal of the fourth transistor, and a first non-control terminal that is coupled to the bases of the first and second transistors.

3. The circuit of claim 2, further comprising a first current source that has an output that is coupled to a second non-control terminal and control terminal of the third transistor, and a control terminal that is coupled to an output of the amplifier.

4. The circuit of claim 3, further comprising a second current source that has an output that is coupled to the first non-control terminal of the fifth transistor, and a control terminal that is coupled to the output of the amplifier.

5. The circuit of claim 1, wherein the follower is further arranged in a common-gate cascode configuration.

6. A circuit for providing a regulated signal over a temperature range, comprising:

a thermal voltage PTAT generator that is configured to generate an input signal at a first node that is proportional to temperature;

a follower that is configured to produce a first signal in response to the input signal;

a first and a second transistor that a reconfigured to produce a reference voltage, wherein the produced reference voltage is determined according to the VGS of the second transistor minus the VGS of the first transistor; and wherein the second transistor is further configured to sum the produced reference voltage with the first signal to produce an input current; and a third transistor that is configured to drive the control terminals of the thermal voltage PTAT generator in response to the input current such that a feedback loop is established to regulate the control terminals of the thermal voltage PTAT generator.

7. The circuit of claim 6, wherein the width-to-length ratio of the first transistor is greater than the width-to-length ratio of the second transistor.

8. The circuit of claim 6, wherein the first, second, and third transistors are arranged in a common-gate configuration.

9. The circuit of claim 6, further comprising an amplifier that is configured to drive the first node and a second node that is resistively coupled to the thermal voltage PTAT generator such that the first and second node have equal voltages.

10. The circuit of claim 9, wherein the amplifier is further configured to regulate the VDS of a first current source that is arranged to supply current to the amplifier.

11. The circuit of claim 9, further comprising a second current source that is configured to drive the drain and gate of the first transistor in response to an output of the amplifier and to drive the gates of the second and third transistor in response to the output of the amplifier.

12. The circuit of claim 11, further comprising a third current source that is configured to drive the drain of the third transistor in response to the output of the amplifier.

13. A method for providing a regulated signal over a temperature range, comprising:

using a thermal voltage PTAT generator to generate an input signal at a first node that is proportional to temperature;

producing a first signal in response to the generated input signal;

producing a reference voltage at a summing node, wherein the produced reference voltage is determined according to the VGS of a second transistor minus the VGS of a first transistor;

summing the produced reference voltage with the first signal at the summing node to produce an input current;

driving the control terminals of the thermal voltage PTAT generator in response to the produced input current such that a feedback loop is established to regulate the control terminals of the thermal voltage PTAT generator.

14. The method of claim 13, further comprising producing a correction signal in response to the input signal, controlling a first and a second current source in response to the correction signal, and using the first current source to drive the first node and using the second current source to drive a second node that is resistively coupled to the thermal voltage PTAT generator such that the first and second node are driven to equal voltages.

15. The method of claim 14, further comprising controlling a third current source in response to the correction signal, and using the third current source to drive the drain and gate of the first transistor and to drive the gates of the second and a third transistor, wherein the second and third transistors are arranged as a current-mirror.

16. The method of claim 15, further comprising controlling a fourth current source in response to the correction signal, and using the fourth current source to drive the drain of the third transistor.

17. A circuit for providing a regulated signal over a temperature range, comprising:

means for generating an input signal at a first node that is proportional to temperature;

means for producing a first signal in response to the generated input signal;

means for producing a reference voltage at a summing node, wherein the produced reference voltage is determined according to the VGS of a second transistor minus the VGS of a first transistor;

means for summing the produced reference voltage with the first signal at the summing node to produce an input current; and means for driving the control terminals of the input signal generation means in response to the produced reference voltage such that a feedback loop is established to regulate the control terminals of the input signal generation means.

18. The circuit of claim 17, further comprising means for producing a correction signal in response to the input signal, means for controlling a first and a second current source in response to the correction signal, wherein the first current source is arranged to drive the first node and wherein the second current source is arranged to drive a second node that is resistively coupled to the thermal voltage PTAT generator such that the first and second node are driven to equal voltages.

19. The circuit of claim 18, further comprising means for controlling a third current source in response to the correction signal, wherein the third current source is arranged to drive the drain and gate of the first transistor and to drive the gates of the second and a third transistor, wherein the second and third transistors are arranged as a current-mirror.

20. The method of claim 19, further comprising controlling a fourth current source in response to the correction signal, wherein the fourth current source is arranged to drive the drain of the third transistor.

* * * * *

UNITED STATES PATENT AND TRADEMARK OFFICE

CERTIFICATE OF CORRECTION

PATENT NO. : 6,812,683 B1
DATED : November 2, 2004
INVENTOR(S) : Perry Scott Lorenz It is certified that error appears in the above-identified patent and that said Letters Patent is hereby corrected as shown below:

Column 3,
Line 41, change "VOS" to -- VGS --.

Column 4,
Line 54, change "amplifier," to -- amplifier; --.

Column 5,
Line 26, change "a reconfigured" to -- are configured --.

Signed and Sealed this

Fourteenth Day of June, 2005

JON W. DUDAS
*Director of the United States Patent and Trademark Office*